US005945018A

United States Patent [19]

Halén

[11] Patent Number: 5,945,018

[45] Date of Patent: Aug. 31, 1999

[54] CONTROL SYSTEM FOR AN OVEN HAVING MULTIPLE HEATING SOURCES FOR THE PREPARATION OF FOOD

[75] Inventor: Eva S. Halén, Stockholm, Sweden

[73] Assignee: Aktiebolaget Electrolux, Stockholm, Sweden

[21] Appl. No.: 08/981,180

[22] PCT Filed: Jun. 17, 1996

[86] PCT No.: PCT/SE96/00788

§ 371 Date: Mar. 13, 1998

§ 102(e) Date: Mar. 13, 1998

[87] PCT Pub. No.: WO97/00596

PCT Pub. Date: Jan. 3, 1997

[30] Foreign Application Priority Data

Jun. 15, 1995 [DK] Denmark ..... 0682/95

[51] Int. Cl.[6] ..... H05B 1/02

[52] U.S. Cl. ..... 219/492; 219/497; 219/486; 219/508; 99/327; 99/333

[58] Field of Search ..... 219/492, 497, 219/506, 483–486, 680–683; 99/325, 328, 331, 333

[56] References Cited

U.S. PATENT DOCUMENTS

| | | | |
|---|---|---|---|
| 4,488,025 | 12/1984 | Tanabe | 219/681 |
| 4,647,746 | 3/1987 | Eke | 219/681 |
| 4,812,606 | 3/1989 | Eke | 219/681 |
| 4,831,227 | 5/1989 | Eke | 219/681 |
| 5,177,333 | 1/1993 | Ogasawara | 219/680 |
| 5,408,075 | 4/1995 | De Matteis et al. | 219/708 |

*Primary Examiner*—Mark Paschall
*Attorney, Agent, or Firm*—Pearne, Gordon, McCoy & Granger LLP

[57] ABSTRACT

An oven having two sources of heat is controlled to perform high quality results when the user simply chooses the class of food on a front panel. A first source of heat is active during a first period until a second source of heat takes over during a second period until the temperature rises to a specific temperature threshold. The time required to reach this specific temperature threshold is measured. The measured time is dependent on the size and type of the food to such a degree that the remaining baking time can be determined with high precision along with the required baking temperature during the remaining baking time. The oven then preforms baking for the remaining baking time using either or both of the first and second sources of heat and informs the user about the remaining baking time.

15 Claims, 3 Drawing Sheets

CONTROL SYSTEM FOR AN OVEN HAVING MULTIPLE HEATING SOURCES FOR THE PREPARATION OF FOOD

BACKGROUND OF THE INVENTION

The invention relates to an oven for food products with means for controlling the supply of heat in accordance with the progress of the cooking effected.

Ovens are known in which a temperature sensor is pushed into the food to be cooked which monitors the temperature development. Long experience with manual adjustment has built up a body of data which enables a feedback loop to be established around a temperature sensor and a power controller. This enables a very precise cooking and consistent results, provided the sensor is fitted absolutely correctly into the food. However, the need for an invasive sensor is percieved as impractical, as it requires frequent cleaning, and the need for high temperature plugs and sockets which are exposed to the humid, perhaps smoky and fatty atmosphere in the oven makes this solution less attractive. On the other hand, non-invasive techniques generally require a knowledge of the weight of the food.

In EP 0 239 290 B1 there is described a partial solution to the above problems in conjunction with a microwave oven where, after a cooling-down period to a specific temperature, the temperature rise due to application of heat is determined and used in conjunction with stored information for deciding on remaining cooking time and a maximum temperature of the oven during this time. However, the need for recalibration by means of cooling is complex and time-consuming, and the precision in the determination of the temperature rise is not sufficient to consistently provide a high quality result, in particular with an extended range of foodstuffs, including as cakes and pastry. There is hence scope for improving such methods for cooking and baking with minimal involvement of the user, in other terms there is a need for an expert-system type solution to the general problem of cooking food to a preferred quality.

BRIEF SUMMARY OF THE INVENTION

It has now been recognized that the food product itself constitutes a load on the supply of heat, and the changes in the product as cooking progresses express themselves as changes in the load. The oven as well as the food product possesses a thermal mass, but in particular the water content of the food product changes the heating function from a simple exponential relationship. Also the heat absorbing properties of the surface of the food product change with cooking which further removes the heating function from a simple relationship. It has, however, now been recognized that a great simplification in the use of an oven may be obtained by judicious use of the concept of thermal load. It is the purpose of the invention to provide an oven of the kind identified above in which the only necessary informational input from the user is the type or category of food to be cooked. Optional input may relate to the degree of cooking or baking and the initial status, e.g. frozen or "to be re-heated".

An oven which fulfils this purpose is peculiar in that during a heating-up phase it heats the food by alternating between at least two types of heat source while the relationship between oven temperature and time is logged and used for controlling the type of heat source and the supply of power during the remainder of the cooking time in accordance with the type of food being cooked.

In order to control the process an embodiment of the invention is particular in that the oven temperature is determined by means of at least one thermometric device fixed in the oven. Another advantageous embodiment is particular in that several thermometric devices are used, at least one of which being placed where heat is transported by convection. A further advantageous embodiment is particular in that at least another thermometric device is shielded from convection. These embodiments all serve to create as relevant an input to the control circuit as possible, and the ability to distinguish between air flow temperature and cavity temperature is very indicative of the processes taking place in the oven.

A functional relationship between the heat sources involved is particular in that heat is supplied by a first source of heat for a first predetermined period of time, followed by a second period of time during which heat is supplied by a second source of heat, that said second period is ended by the reaching of a threshold temperature, the total time to reach the threshold determining the total cooking time by means of a stored multiplication factor, and that during the remaining time heat is supplied by thermostatic control at a temperature determined by a stored weighting function.

Another functional relationship uses a temperature rather than a time control and is particular in that heat is supplied by a first source of heat until a first predetermined temperature is reached, after which heat is supplied by a second source of heat until a second predetermined temperature is reached, the total time from start to the reaching of the second predetermined temperature is reached being measured and used for calculating and displaying the total cooking time by means of a stored multiplication factor, and that during the remaining time heat is supplied by thermostatic control at a temperature determined by a stored weighting function in dependence of the food-to be treated in the oven, and that upon reaching the end of the total cooking time the oven switches itself off.

It has been realized that sufficient difference between the sources of heat may be obtained in a construction which is particular in that the second source of heat is constituted by a fan in correspondence with the oven cavity optionally in conjunction with the first source of heat. This fan may also be used at any temperature to generate an equilibrium of temperature in the oven cavity, e.g. near room temperature where the switch from one heat source to another is of great importance for correct determination of total cooking or baking time. This would in many cases mean that the first heat source is not switched on when the fan is active.

Using the concept of thermal load and expressing the process in similarity with the terms of impedance, potential, voltage, etc. known from electric circuit theory, the oven may be said to supply heat at different but well-defined potentials and with different heat flow source impedances in order to obtain automatically a characterization of the load related to its thermal capacity and internal thermal conductivity, i.e. the thermal load impedance of the food. The principal parameter which is measured continuously is the temperature in the oven, and obviously the time from the starting point. Another relevant parameter is the instantaneous power supplied to the heat source. In the case of an electric heating element this may be efficiently performed by measuring the mains voltage. This, combined with stored information as to the properties of different types of load, i.e. different foods, allows automatic control of the cooking process and to calculate and indicate the expected total cooking or baking time. The types of heat source used is decided by the range of types of food that a particular oven should be able to process. Modern ovens would e.g. utilize infrared radiation, steam, hot air, and microwaves in any combination. The continuous monitoring of the development over time allows the automatic selection of a characteristic which relates to a specific starting temperature other than room temperature, in order that the user is still advertised about the expected cooking or baking time.

There is a possibility to absorb manufacturing tolerances by calibrating the heating function during a dry run with an empty oven, and this also means that individual deviations in the radiative losses to the surroundings will also be absorbed and will have no discernible influence on the performance of the oven for the various types of food it can process. The power taken up by the heating elements is monitored continuously and thus deviations caused by an exchange of elements are absorbed.

BRIEF DESCRIPTION OF THE SEVERAL VIEWS OF THE DRAWING

The invention will be described in further detail with reference to the drawing, in which FIG. 1 schematically shows an oven with typical heat sources.

DETAILED DESCRIPTION OF THE INVENTION

Figure 1:
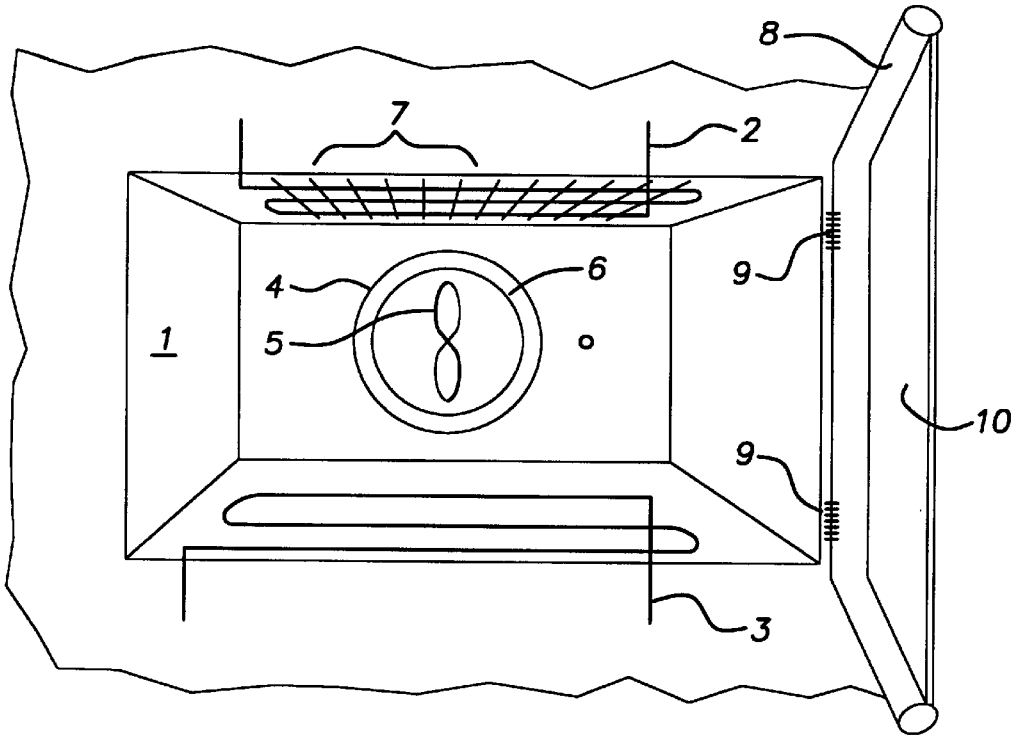

In FIG. 1 is shown an embodiment for an oven according to the invention with a cavity 1 with heating elements in the top 2 and bottom 3, and an aperture 4 for a fan or ventilator 5 which also may function as an active heating element in the form of a ring element 6 in the air stream. A grill element is shown at 7. Furthermore the door 8 with hinges 9 and a glass pane 10 are indicated. An efficient oven may have an air velocity of the ventilator from 1 to 4 m/s, and in case power is supplied to the ring heating element, the oven functions as a hot air oven. The embodiment described in this example is a purely thermal oven, and the media for transfer of the heat are mainly convection (due to the ventilator which may itself supply hot air as described) and radiation. The heat losses to the environment occur predominantly by radiation.

Figure 2:
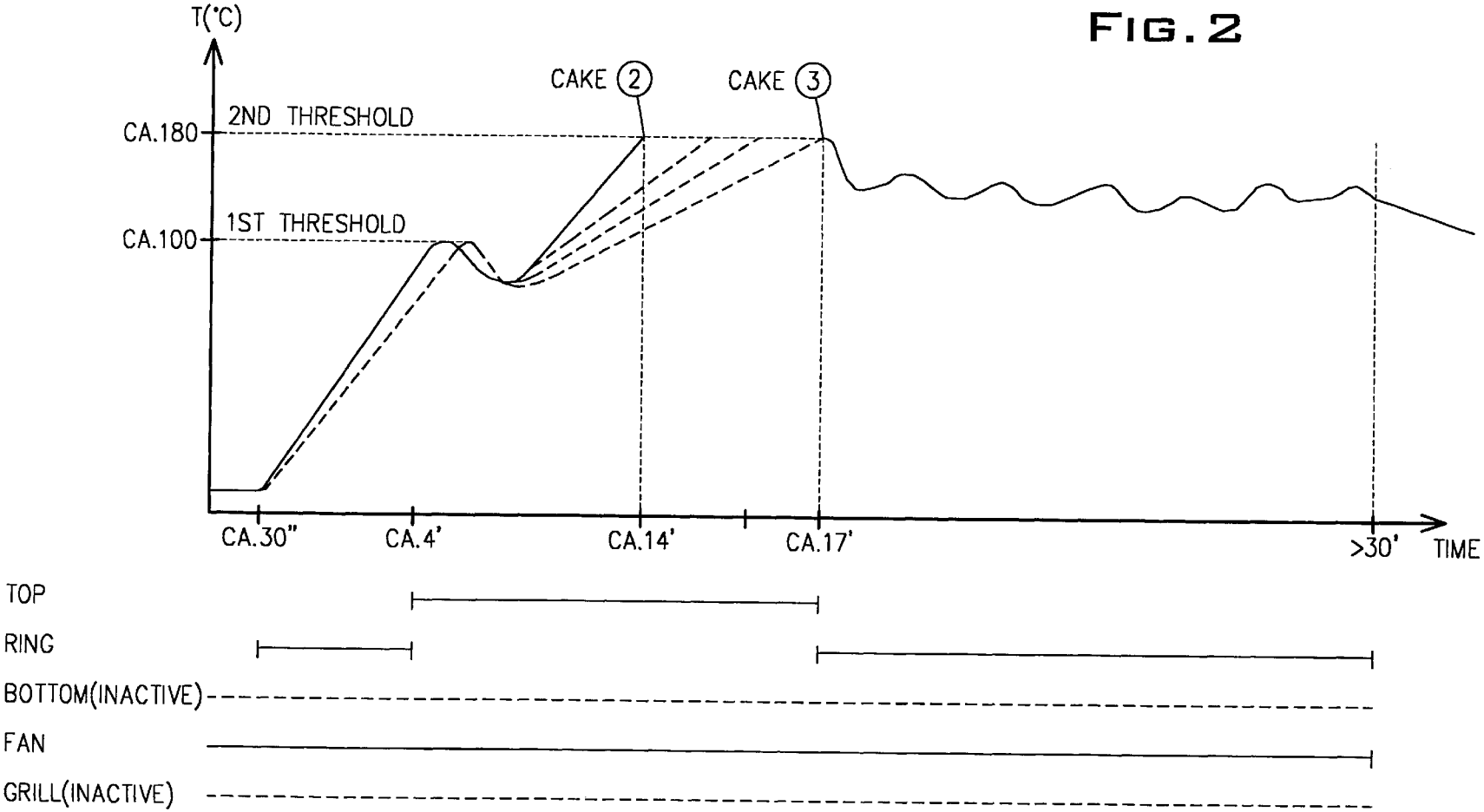
FIG. 2 shows typical temperature development and heat supply functions, FIG. 3 schematically shows the inputs and outputs of the baking control unit.

The basis for the invention lies in the observation of previously unknown behaviour of food when heated with different heat sources at different times during the cooking process. The embodiment described above gives rise to the temperature developments shown in FIG. 2 when the power to the oven is supplied as shown at the bottom. Other choices of parameters will give rise to similar but different curves. During a first period after switching on of the baking control unit the ambient temperature is determined and the information is stored for compensating purposes. During a first period shown in the figure as from 30" to about 4' heating takes place by means of the ventilator and the ring heating element, and the temperature rises until a first temperature limit which is reached at ca. 100° C. where the specific evaporation heat of water absorbs quite a lot of heat without temperature rise, and it is seen that there is some variation according to type of cake. The temperature is measured by means of a temperature sensing element which is placed in the hind wall at some distance from the apertures from the ventilator. The control unit switches to using the top heating element instead of the ring heating element while the ventilator is still active. An initial reduction in temperature is followed by a rise over time which is specific to the type of cake being baked. This means that the second threshold which is set to be in the neighbourhood of 180° C. is reached at times which are specific to the type of cake (cake types 2 and 3 circled). The variation of the occurance of the time of reaching the second threshold is so specific that unprecedented control over the baking process may be obtained. The time is in the neighbourhood of 15' from the start. It should be noted that the first 30" may be used for averaging the temperature in the oven by means of the fan in order to obtain a precise starting temperature on the sensor.

At the time the second temperature limit is reached, the following activities are performed by the baking control unit. The top heating element is now switched off and the ring heating element in conjunction with the ventilator is the sole supply of heat, the oven in effect acting as a hot air oven under thermostat control, the temperature sensor being the input for the thermostat. The baking control unit is enabled to determine the control (thermostat) temperature and the time left which is a) indicated on a display on the baking control unit, and b) used for switching off the heating when the cake is ready. In practical use, the user will perceive the first ca. quarter of an hour as a preparation and "diagnostic" time, determining the properties of the cake to be baked, and the indication of time left is useful for knowing when to take a freshly baked cake out. In case more time is desired, a provision may be made at the control panel to increase the baking time while retaining full oven control.

Figure 3:
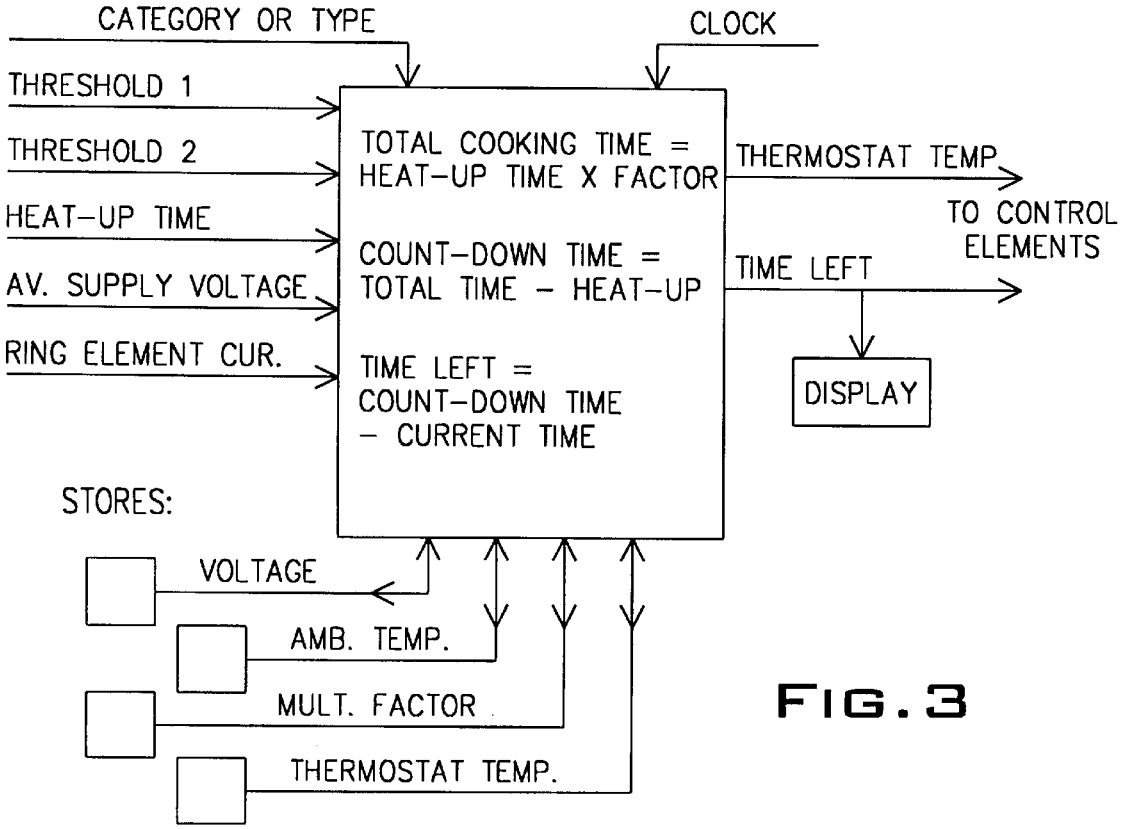

In order to be able to do this, the baking control unit must be in possession of the following information as shown schematically in FIG. 3:

the two threshold temperatures, the time to reach the first and second threshold temperatures (or alternatively, the temperatures reached after pre-determined specific times), the average input voltage, the ring element current (giving the effective wattage), and the thermal mass of the oven. The latter is obtained by means of a calibrate function during a dry run of the oven. This activity will also absorb manufacturing tolerances as to e.g. the thermal insulation. The ambient temperature is monitored as the temperature at the initiation of the baking process.

Furthermore, a number of test runs with the specific embodiment has resulted in factors linking the heat-up time to the second threshold temperature with the total cooking time, which in turn means that stored information of this type is available for determining the remaining time (time left). Similarly, the actual control or thermostat temperature during this remaining time has also been determined for a number of cake types and sizes. The baking control unit uses the stores of tabulated values in order to determine the remaining time and switch off when this has passed with due compensation for residual heat, as well as the adjustment of the thermostat temperature for the result to be in consistency with the desired quality.

Figure 4:
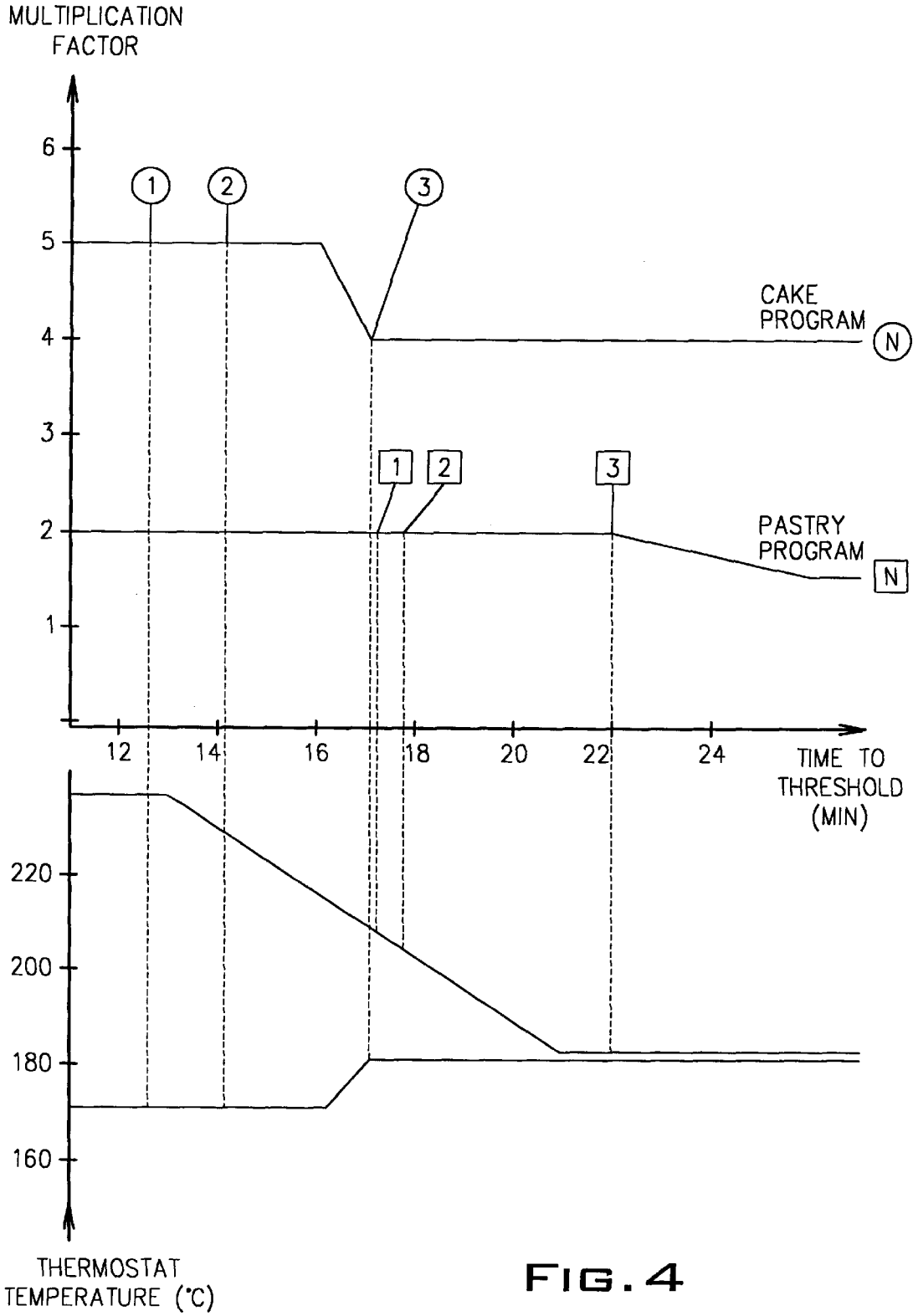
FIG. 4 shows typical weighting functions.

In FIG. 4 is shown some results of such test runs, however represented in such a way that the independent variable is the time to reach the second threshold and the dependent variables are the factor with which the heat-up time has to be multiplied and the control (thermostat) temperatures. These may be termed weighting functions. Cake types are indicated by numerals in circles, and pastry types are indicated by numerals in squares. It will be noted that both the multiplication factors and the thermostat temperatures are quite distinctly different for the different types of food which reflects among other things their different water content and degree of desirable browning.

In the above description and discussion the embodiment has been a thermal oven with hot air oven capabilities. However, similar functions may be effected by means of other combinations of heat sources, such as steam or microwaves in any combination with radiated or convected heat.

I claim:

1. An oven for cooking food products with means for controlling the supply of heat in accordance with the progress of the cooking effected, said oven comprising:

an oven cavity for holding the food products to be cooked;

a first heat source for heating food products in said oven cavity from a starting time until a threshold time is reached;

a second heat source for heating food products in said oven cavity after the threshold time is reached until a threshold temperature is reached, said second heat source being a different type of heat source than said first heat source;

means for maintaining a cooking temperature in said oven cavity using at least one of said first heat source and said second heat source after the threshold temperature is reached until a finishing time is reached;

means for measuring temperature in said oven cavity;

means for measuring a total time to reach the threshold temperature from the starting time;

means for determining the finishing time as a function of the total time to rise to the threshold temperature and a predetermined and stored multiplication factor; and means for determining the cooking temperature as a function of a predetermined and stored weighting function.

2. The oven according to claim 1, wherein said means for measuring temperature includes at least one temperature sensor fixed in the oven cavity.

3. The oven according to claim 2, wherein said means for measuring temperature includes a plurality temperature sensors, wherein at least one of said temperature sensors is placed where heat is transported by convection.

4. The oven according to claim 3, wherein at least one of said temperature sensors is shielded from convection.

5. The oven according to claim 3, further comprising a fan for moving air within said oven cavity which is optionally operable with said first heat source and said second heat source.

6. The oven according to claim 3, wherein said first heat source is a hot air oven.

7. An oven for cooking food products with means for controlling the supply of heat in accordance with the progress of the cooking effected, said oven comprising:

an oven cavity for holding the food products to be cooked;

a first heat source for heating food products in said oven cavity from a starting time until a first threshold temperature is reached;

a second heat source for heating food products in said oven cavity after the first threshold temperature is reached until a second threshold temperature is reached, said second heat source being a different type of heat source than said first heat source, said second threshold temperature being greater than said first threshold temperature;

means for maintaining a cooking temperature in said oven cavity using at least one of said first heat source and said second heat source after the second threshold temperature is reached until a finishing time is reached;

means for measuring temperature in said oven cavity;

means for measuring a total time to reach the second threshold temperature from the starting time;

means for determining the finishing time as a function of the total time to rise to the second threshold temperature and a predetermined and stored multiplication factor; and means for determining the cooking temperature as a function of a predetermined and stored weighting function.

8. The oven according to claim 7, wherein said means for measuring temperature includes at least one temperature sensor fixed in the oven cavity.

9. The oven according to claim 8, wherein said means for measuring temperature includes a plurality temperature sensors, wherein at least one of said temperature sensors is placed where heat is transported by convection.

10. The oven according to claim 9, wherein at least one of said temperature sensors is shielded from convection.

11. The oven according to claim 7, further comprising a fan for moving air within said oven cavity which is optionally operable with said first heat source and said second heat source.

12. The oven according to claim 7, wherein said first heat source is a hot air oven.

13. A method of controlling an oven for cooking food products in accordance with the progress of the cooking effected, said method comprising the steps of:

identifying a type of food product to be cooked in the oven;

operating a first heat source for a first period of time for raising the temperature and heating the food products in a cavity of the oven;

operating a second heat source for a second period of time following the first period of time for raising the temperature and heating the food products in the oven cavity until a threshold temperature is reached, the second heat source being a different type of heat source than the first heat source;

maintaining a cooking temperature in the oven cavity for a third period of time using at least one of the first heat source and the second heat source after the threshold temperature is reached until a finishing time is reached;

measuring temperature in the oven cavity to determine when the threshold temperature is reached;

measuring a total time to reach the threshold temperature;

determining the finishing time as a function of the measured total time to rise to the threshold temperature and predetermined and stored multiplication factors for different types of food products; and determining the cooking temperature as a function of predetermined and stored weighting functions for different types of food products.

14. The method according to claim 13, wherein said step of operating the first heat source for the first period of time is stopped when a time threshold is reached.

15. The method according to claim 13, wherein said step of operating the first heat source for the first period of time is stopped when a lower temperature threshold is reached.

* * * * *